US005440791A

United States Patent [19]

Guio

[11] Patent Number: 5,440,791

[45] Date of Patent: Aug. 15, 1995

[54] SOCK CLIP

[76] Inventor: Robert R. Guio, 146 Highland Hills Dr., Follansbee, W. Va. 26037

[21] Appl. No.: 136,889

[22] Filed: Oct. 18, 1993

[51] Int. Cl.[6] ..... A44B 21/00

[52] U.S. Cl. ..... 24/545; 24/543; 24/562; 24/DIG. 29

[58] Field of Search ..... 24/545, 543, 562, 563, 24/336, 570, 489, 67.9, 557, 487, 457, 518, DIG. 29; 2/239, 240

[56] References Cited

U.S. PATENT DOCUMENTS

| | | | |
|---|---|---|---|
| D. 34,560 | 5/1901 | DeLong . | |
| D. 249,927 | 10/1978 | Takahashi et al. . | |
| D. 319,903 | 9/1991 | Barner . | |
| 1,402,153 | 1/1922 | Dusinberre . | |
| 1,556,127 | 10/1925 | Pruett . | |
| 1,625,920 | 4/1927 | Thurman . | |
| 2,462,973 | 3/1949 | Kelrick | 24/343 |
| 2,506,675 | 5/1950 | Letts | 24/336 |
| 3,629,912 | 12/1971 | Klopp | 24/457 |
| 3,900,181 | 8/1975 | Pitanis . | |
| 3,982,307 | 9/1976 | Smith et al. | 24/543 |
| 4,097,967 | 7/1978 | Conner, Jr. | 24/30.5 R |
| 4,148,114 | 4/1979 | Wier | 24/67.9 |
| 4,765,335 | 8/1988 | Schmidt et al. . | |
| 4,807,334 | 2/1989 | Blanchard . | |
| 4,939,823 | 7/1990 | Klein . | |
| 5,022,126 | 6/1991 | Davis | 24/543 |
| 5,038,413 | 8/1991 | Ursino | 24/DIG. 29 |
| 5,044,051 | 9/1991 | Klein . | |

FOREIGN PATENT DOCUMENTS

| | | | |
|---|---|---|---|
| 0805122 | 11/1936 | France | 24/562 |
| 0806473 | 6/1951 | Germany | 24/557 |
| 0304694 | 4/1955 | Switzerland | 24/557 |
| 2196683 | 5/1988 | United Kingdom | 24/DIG. 29 |

*Primary Examiner*—Victor N. Sakran
*Attorney, Agent, or Firm*—Richard Litman

[57] ABSTRACT

A clip preferably monolithically formed of a single piece of resilient and pliable material (e.g., plastic), provides for the securing together of individual units of stocking, socks, and hose and the like, into their proper pairs for ease of sorting for laundry and storage. The clip provides a gripping force biasing the jaws shut, by means of a spring action in the handle portion or by alternative latching means between the two handle portions, while the jaws are relatively wide to distribute the clamping or gripping forces so as to preclude crushing of the fabric or other pliable material gripped therein. The clip may be provided in a variety of colors, in order that they and any articles gripped therein may be recognized readily, and a storage container which is easily attachable in the laundry area (e.g., to the side of a laundry hamper) may be provided for the storage of the clips when they are not in use. The relatively soft and non-metallic material serves to preclude the scratching, marring or other damage to the interior or a laundry washer or dryer drum while in service.

15 Claims, 4 Drawing Sheets

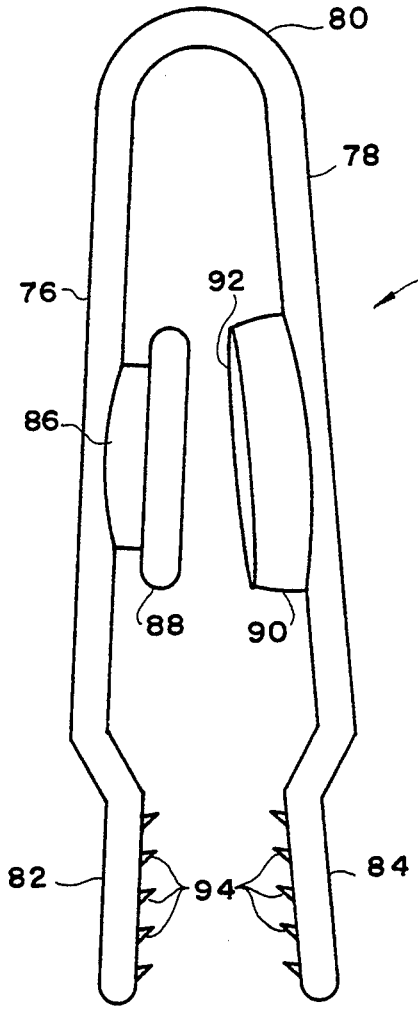
Fig. 4
Fig. 5
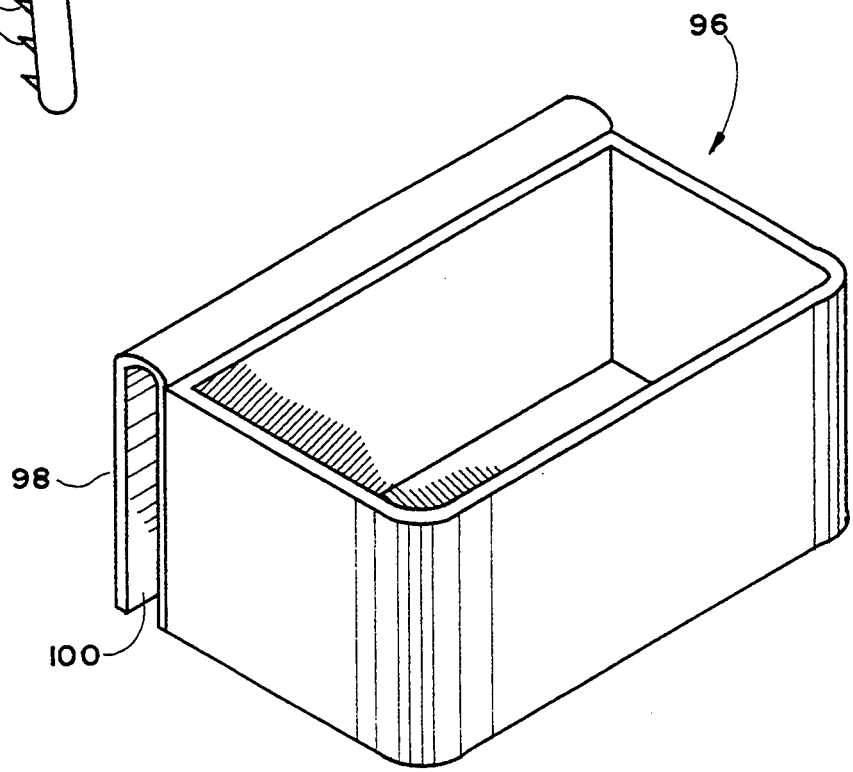

SOCK CLIP

FIELD OF THE INVENTION

The present invention relates generally to clips and clamping devices, and more specifically to various embodiments of a clip providing for the securing together of the individual members of a pair of socks, stocking, hose or the like for laundering and/or storage.

BACKGROUND OF THE INVENTION

Even with today's modern automated appliances, time has become more and more precious. One of the more onerous tasks required of the typical household is that of periodic laundry. While automated washers and dryers have simplified this chore, it still requires the sorting of clothing and other washable articles into various types according to color and other properties, and requires further sorting when the laundry is done to place the clean clothing or articles in the proper area. While this part of the chore may be readily accomplished with most clothing articles, it nevertheless requires additional time, and in some cases a fair amount of care is required to sort properly some paired articles which may have a similar appearance between different individual units.

Socks, stocking, and hose and the like are a prime example, as oftentimes such clothing articles tend to be conservatively colored or patterned, and great care must be taken to preclude the mismatching of individual articles. While various devices have been developed to provide for such pairing of socks and the like for laundering and/or storage, they suffer from various deficiencies as will be discussed below.

The need arises for a clip providing for the pairing of socks, stocking, and hose and the like, which clip precludes damage to the sock or other article to which it is secured, or gathering of the fabric thereof. The clip should also be provided in a variety of colors, in order for household members or others to determine readily the clip(s) assigned for their use, and any socks or the like which may be secured thereby. A container may also be provided for the storage of unused clips in a handy place, e.g., adjacent a clothes hamper or the like.

DESCRIPTION OF THE PRIOR ART

U. S. Pat. No. 1,402,153 issued to George B. Dusinberre on Jan. 3, 1922 discloses a Clip formed of two mating and interlocking stampings of sheet material. The relative thinness of the material required for the interlocking portion of the clip requires that the portions be formed of a relatively durable material such as metal, which would not be suitable for the environment of the present invention due to its tendency to rust in moist conditions and to scratch or mar the interior of the washer and dryer drums when placed therein. Moreover, no additional means of improving the grip of the jaws is disclosed, which would likely result in slippage and disengagement from the article held therein during a washing or drying cycle.

U. S. Pat. No. 1,556,127 issued to William A. Pruett on Oct. 6, 1925 discloses a Bait Can Holder formed of relatively thin stamped material. A can is gripped within the device, which can serves as a stop for a lid portion. No means is seen to provide for the secure gripping of a relatively thin, flaccid article by the device, nor for storing any such articles therein.

U.S. Pat. No. 1,625,920 issued to Fred A. Thurman on Apr. 26, 1927 discloses a Box containing a plurality of segments therein and including a lid. The device is arcuate in form, and due to the separate lid, plural divisions therein, and inability to secure to a flat surface (e.g., laundry hamper) is unsuitable for use as a container for the clips of the present invention.

U. S. Pat. No. 3,900,181 issued to Nicholas J. Pitanis on Aug. 19, 1975 discloses a Dual Purpose Sock Holder having a breakaway hanger which may be removed after sale of the article held thereby. Two openings are provided, with plural teeth within each opening providing for the gripping of an article inserted therein. The requirement that an article of clothing inserted therein be drawn over the immovable teeth could result in the snagging or tearing of the article, and the gathering of the fabric within the openings would result in less efficient cleaning of the article(s) contained therein.

U.S. Pat. No. 4,765,335 issued to Ferenc J. Schmidt et al. on Aug. 23, 1988 discloses an Aneurism Clip formed of a single piece of titanium or titanium alloy. The deficiencies of such a metal clip used in the environment of the present invention have been noted above in the discussion of the Dusinberre patent. Moreover, the relatively narrow, rod-like jaws do not appear to provide the distribution of force desirable to preclude crushing of the fabric.

U. S. Pat. No. 4,807,334 issued to Russell 0. Blanchard on February 28, 1989 discloses an Article Hanger Clip having a series of staggered, opposed jaws therein. The lack of directly opposite gripping members appears to limit the amount of grip available for securing articles as they a through the turbulence of washing.

U. S. Pat. No. 4,939,823 issued to Milton L. Klein on Jul. 10, 1990 discloses a Sock Palter And Holder comprising a loop having a pin at one end and a cooperating socket at the opposite end. The article(s) secured thereby are punctured by the pin, and thus damaged, by using the device.

U. S. Pat. No. 5,044,051 issued to Milton L. Klein on Sept. 3, 1991 discloses a Pairer And Holder for Sock Pairs, And A Method Of Pairing And Holding Sock Pairs. The device is very similar to the patentee's '823 patent discussed immediately above.

U.S. Pat. No. Des. 34,560 issued to Frank E. DeLong on May 28, 1901 discloses a Paper Fastener formed of wire and having a relatively narrow engagement between the two jaws. The narrow gripping area provided by the wire elements, as well as the unsuitability of the metal material for use in the environment of the present invention, render the device unsuitable.

U.S. Pat. No. Des. 249,927 issued to Kiyoshi Takahashi et al. on Oct. 17, 1978 discloses a Biased Cup Clamp having a relatively thin gripping a edge between the two jaws, and thus unable to spread the gripping force properly for use with relatively soft, flaccid articles such as stockings and the like.

Finally, U.S. Pat. No. Des. 319,903 issued to Edward L. Barner on Sept. 10, 1991 discloses a Stocking Holder comprising a ring having a series of inwardly pointing projections therein. The fabric material must be gathered and stuffed through the ring and projections, which action would likely result in the snagging or tearing of the material, and inadequate washing and drying thereof.

None of the above noted patents, taken either singly or in combination, are seen to disclose the specific arrangement of concepts disclosed by the present invention.

SUMMARY OF THE INVENTION

By the present invention, an improved clip for the securing of individual socks, stockings, and hose or the like to form a pair thereof for laundering and storage, is disclosed.

Accordingly, one of the objects of the present invention is to provide an improved clip which includes relatively wide jaws providing for the distribution of clamping force to preclude crushing of articles therein, and means providing for the biasing of the jaws together.

Another of the objects of the present invention is to provide an improved clip in which the jaws are disposed at substantially right angles to the handle portion of the clip.

Yet another of the objects of the present invention is to provide an improved clip which includes spring means providing for the biasing of the jaws together.

Still another of the objects of the present invention is to provide an improved clip which includes latching means providing for the biasing of the jaws together.

A further object of the present invention is to provide storage means for such clips.

An additional object of the present invention is to provide an improved clip which is provided in plural colors to provide for ready recognition of a specific clip, and thereby readily identify any socks or the like secured thereto.

Another object of the present invention is to provide an improved clip which is monolithically formed of a single piece of material.

Yet another object of the present invention is to provide an improved clip which is formed of a resilient and pliable material in order to preclude damage to the interior of a laundry appliance.

A final object of the present invention is to provide an improved clip for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 4 is a side view of a fourth embodiment, showing a latching means related to the embodiment of FIG. 1.

FIG. 5 is a perspective view of a container for the various clips of FIGS. 1 through 4.

Similar reference characters denote corresponding features consistently throughout the several figures of the attached drawings.

DETAILED DESCRIPTION OF THE PREFERRED EMBODIMENTS

Figure 1:
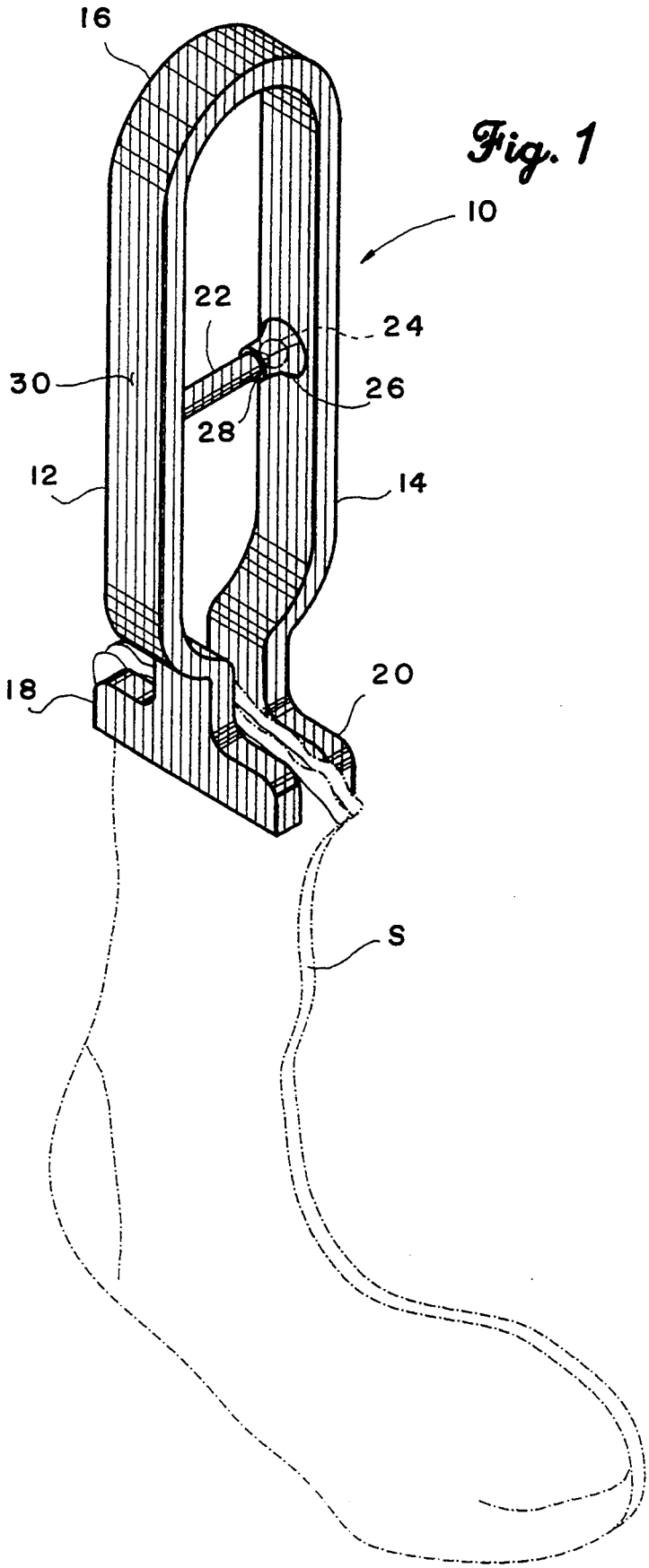
FIG. 1 is a perspective view of a first embodiment of the clip of the present invention, showing the ball and socket latching means and identifying coloring.

Referring now particularly to FIG. 1 of the drawings, the present invention will be seen to relate to a clip 10 providing for the securing together of individual socks to form a matched pair S thereof. Clip 10 of FIG. 1 generally comprises a first and a second arm 12 and 14, joined at their proximal ends by an arcuate spring connecting member 16, serving to bias the two arms 12 and 14 apart from one another. The distal ends of each of the arms 12 and 14 include respective first and second jaws 18 and 20, arranged to be closely adjacent and parallel to one another when the first and second arms 12 and 14 are generally parallel to one another.

Jaws 18 and 20 will be seen to be joined to the distal ends of their respective arms 12 and 14 at the midpoints of the jaws, and to form substantially 90 degree angles with the axes of their respective arms 12 and 14. In other words, each of the jaws 18 and 20 resembles the cross member of a T shape, with the respective arms 12 and 14 forming the stems of the T shapes. Thus, the clip 10 may be suspended from an appropriate support (rod, hook, etc.) by the arcuate connecting portion 16, if desired with the jaws 18 and 20 being disposed substantially horizontally in order to spread the fabric of any material grasped therein to a greater degree, thereby allowing better drying of moist articles, less gathering of the fabric, etc.

The clip 10 of FIG. 1 provides a means for biasing the two jaws 18 and 20 together, comprising a ball and socket arrangement. A securing rod 22 is formed to extend from the inner side of the first arm 12, with a ball 24 formed at the distal end of the securing rod 22. A cooperating socket 26 is formed on the inner side of the second arm 14. The socket includes an outer lip 28 which is slightly smaller in diameter than the ball 24, thus requiring the ball 24 to be urged into the socket 26 past the lip 28, and firmly securing the ball 24 within the socket 26 once engaged, thereby to hold the jaws 18 and 20 in close proximity to one another and grasp firmly any articles interposed therebetween. As the clip 10 is preferably monolithically formed of a resilient material (e.g., plastic) as a single, unitary piece of material including the above components, the socket lip 28 provides sufficient compliance to allow the ball 24 to be forced past the lip 28 and to be retained within the socket 26. The operation may be easily reversed by drawing the two arms 12 and 14 apart, to cause the ball 24 to pop loose from the retaining lip 28, and thereby disengage from the socket 26 and allow the jaws 18 and 20 to be spread to remove or insert articles therebetween.

In addition to the above features, it will be noted that the clip 10 is provided with an identifying colored surface 30 (preferably red, in the case of the clip 10 of FIG. 1, although other colors may be used as desired). By providing different identifying colors for the various clips of the present invention, articles (e.g., sock pairs S) contained therein may be more easily and readily identified by a person sorting the completed laundry. If, for example, one member of the family (e.g., daughter) always uses a red colored clip for his/her socks, then the person sorting the laundry need only gather up all articles secured by red clips, and store them in the daughter's appropriate storage area (dresser drawer, etc.). Other clips may be provided in other colors to facilitate the sorting process.

Figure 2:
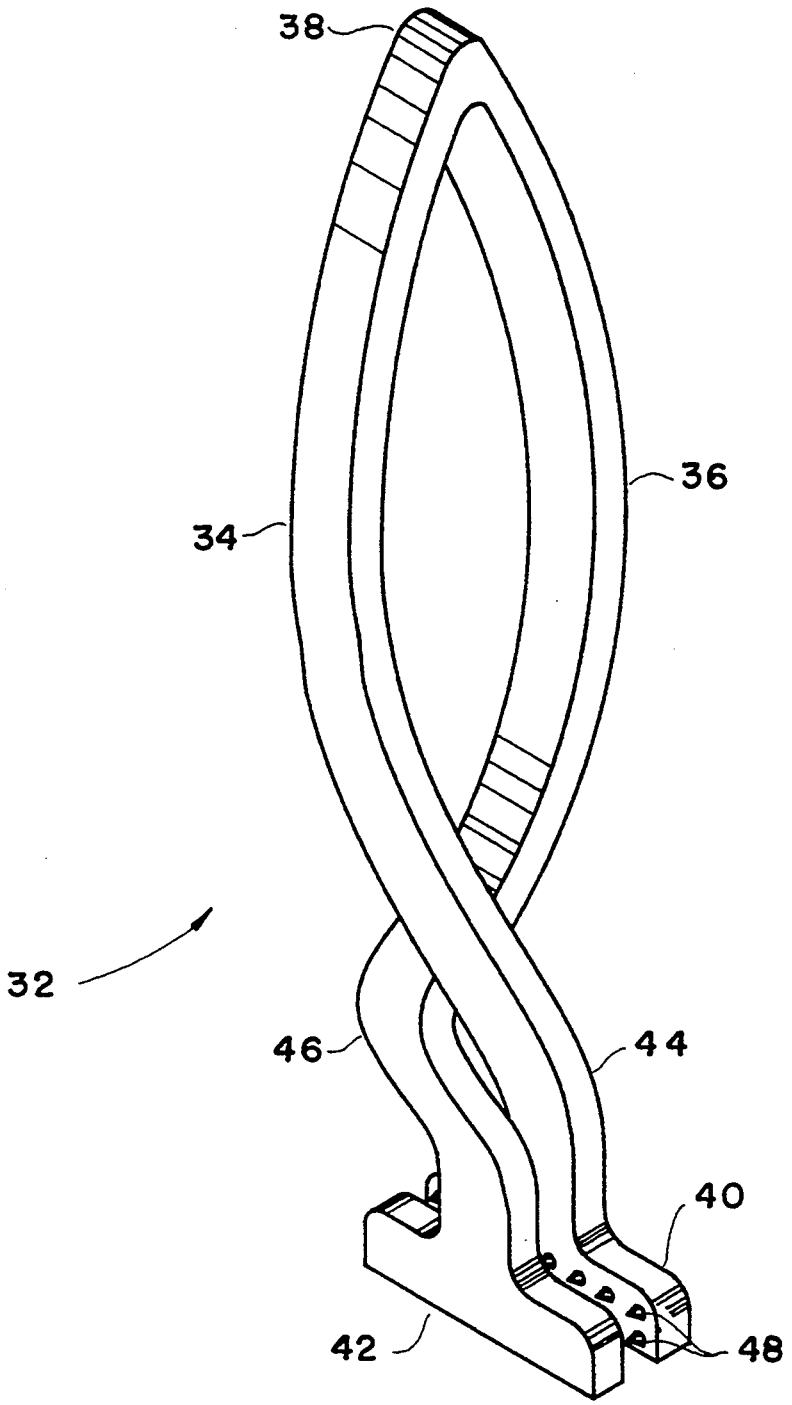
FIG. 2 is a perspective view of a second embodiment, showing an alternative means of biasing the jaws together.

FIG. 2 discloses a clip 32 comprising an alternative second embodiment of the present invention. Clip 32 includes first and second arms 34 and 36 and a connecting member 38 between the proximal ends thereof, in the manner of the clip 10 of FIG. 1. First and second jaws 40 and 42 extend from the distal ends 44 and 46 respectively of the first and second arms 34 and 36, in the manner of the clip 10 of FIG. 1. As in the case of the clip 10 of FIG. 1, these two arms 34 and 36 are biased apart by the resilient spring action of the connecting member 38. However, each of the distal ends 44 and 46 of the arms 34 and 36 will be seen to have an offset or sinusoidal curve, whereby each of the distal ends 44 and 46 bypasses and crosses by the opposite distal end. Thus, the biasing force provided by the connecting member 38 to urge the arms 34 and 36 apart, serves to urge the crossed distal ends 44 and 46 (and thus the two jaws 40 and 42) together.

In addition to the above construction and features, the facing sides of each of the jaws 40 and 42 include means providing for the secure gripping of an article interposed therebetween, such as the teeth 48 visible on the inner surface of the first jaw 40. Also, as in the case of the clip 10 of FIG. 1, some identifying coloring may be provided (e.g., white, black, etc.). Clip 32 may be used by applying pressure to the two arms 34 and 36 to urge them together, thereby causing the two jaws 40 and 42 to be spread apart due to the crossover provided by the sinusoidal and offset form of the two distal arm ends 44 and 46. The jaws are automatically urged together by the action of the resilient connecting member 38, serving to urge the arms 34 and 36 apart and thus urge the two jaws 40 and 42 together to secure an article or pair of articles therebetween.

Figure 3:
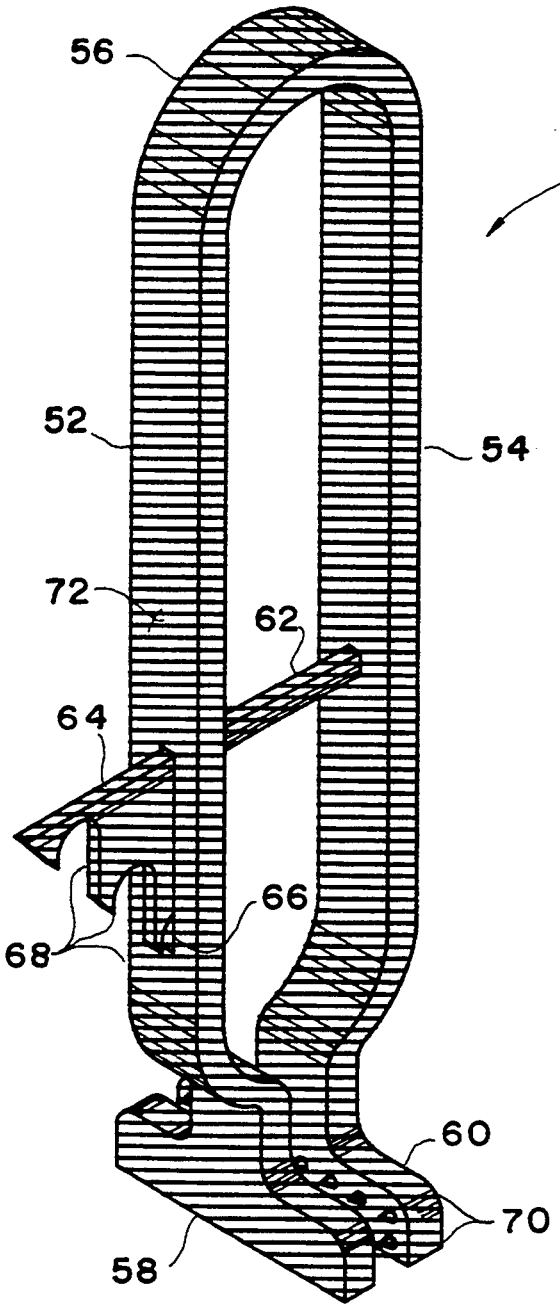
FIG. 3 is a perspective view of a third embodiment, showing a another alternative latching means and coloring.

FIG. 3 discloses a third embodiment of the present invention, comprising a clip 50. Clip 50 is similar to the clip 10 of FIG. 1, having first and second arms 52 and 54, an arcuate resilient connecting member 56 extending between the proximal arm ends, and first and second jaws 58 and 60 respectively extending from the distal ends of the first and second arms 52 and 54. The connecting member 56 urges the two arms 52 and 54, and thus the jaws 58 and 60 extending therefrom, apart from one another, and accordingly, means is provided to urge the two jaws together. A rod 62 extends from the inner surface of the second arm 54, and includes a flange 64 formed in its distal end. The flange 64 cooperates with a slot 66 formed in the first arm 52, and includes a series of notches 68 therein. The rod 62 is resiliently biased downward, so as to urge the flange 64 on the end thereof downward toward the bottom edge of the slot 66. Thus, one of the notches 68 will be automatically urged downward, due to the resilient nature of the material used, to catch on the bottom edge of the slot 66, thereby to secure the two arms 52 and 54 together as desired. By providing a plurality of notches 68 in the flange 64, the grip of the two jaws 58 and 60 may be selectively adjusted to provide grip for thicker or thinner materials. As in the case of the other embodiments, the two jaws 58 and 60 include gripping means or teeth 70, to provide a more effective grip. The colored surface 72 (e.g., blue) of the clip 50 will be seen to provide for ease of identification of that clip 50, and thus any articles contained therein, in the manner of the coloring provided for the clips of the other embodiments disclosed.

Yet another embodiment is disclosed in FIG. 4 of the drawings. The clip 74 of FIG. 4 is formed in a similar manner to the clip 10 of FIG. 1, and includes first and second arms 76 and 78, an arcuate resilient connecting member 80 serving to bias the two arms 76 and 78 away from one another, and first and second jaws 82 and 84 extending respectively from the distal ends of the first and second arms 76 and 78. The clip 74 also includes means providing for the urging of the two arms 76 and 78 together, comprising an extension 86 formed along the inner side of the first arm 76, with an elongated, generally ovoid protuberance 88 formed on the distal portion thereof. This ovoid protuberance 88 cooperates with a mating socket 90 extending from the inner side of the second arm 78, and having an outer lip 92 serving to capture the protuberance 88 within the socket 90. This arrangement operates in a similar manner to that of the ball and socket of clip 10 of FIG. 1, but the extended length of the ovoid protuberance 88 and cooperating socket 90 and lip 92, provide additional security and strength to secure the two arms 76 and 78 (and thus the jaws 82 and 84) toward one another. The operation of the clip 74 is otherwise the same as that for the clip 10 of FIG. 1, with the possible exception of the greater force which may be needed to secure the protuberance 88 within the socket 90 and to remove the protuberance 88 from the socket 90. The clip 74 may also be shaded or colored for identification purposes, as in the case of the clips 10, 32 and 50 respectively of FIGS. 1, 2, and 3, and the jaws 82 and 84 will be seen to include gripping means or teeth 94 thereon to provide for increased security of articles retained therein, in the manner of the clips of FIGS. 1, 2, and 3.

In addition to the above clips, the present invention also provides for storage means for such clips, comprising an open box 96 having a flange 98 secured to the upper edge of the rear side and extending downward therefrom. The rear side and flange 98 define a gap 100 therebetween, with the gap 100 providing for the securing of the box 96 over the edge of a generally planar surface, such as one wall of a laundry hamper. Thus, the box 96 may be installed accordingly, and one or more of the various embodiments of the clips discussed above placed therein for storage.

When soiled socks, stocking or the like are removed for laundering, one of the clips 10, 32, 50, or 74 having color coding according to the household member assigned that specific color of clip, may be used to secure the two socks or stockings together to form an inseparable pair as they are processed through the laundry. The resilient, relatively pliable and soft plastic material of the clips of the present invention ensure that the interiors of the clothes washer and dryer drums will not be marred during the washing and drying cycles. The generally rounded exterior elements of the clips, such as the resilient arm connecting members, further ensure that no sharp edges will catch on other clothing in the laundry cycle and cause damage to such clothing. When laundering is completed, the person sorting the laundered clothing is able to identify immediately the owner of the particular pair of socks and store the socks as a matched pair in their proper storage area without expending undue time and effort, and ready for use by the owner thereof. The clips may then be placed back in the storage box 96, preferably conveniently located at the laundry hamper, for further use.

It is to be understood that the present invention is not limited to the sole embodiments described above, but encompasses any and all embodiments within the scope of the following claims.

I claim:

1. A clip providing for the securing together of single socks, stockings and hose to form a matched pair thereof, comprising:

a first arm and a second arm, with said first arm and said second arm secured together at their respective proximal ends by a resilient connecting member and biasing apart thereby;

said first arm and said second arm each respectively having a first jaw and a second jaw extending from the distal end thereof;

said first jaw and said second jaw each being disposed at substantially a right angle respectively to said first arm and said second arm, with said first arm and first jaw, and said second arm and said second jaw, each respectively forming a substantially T shaped configuration;

said clip having a monolithic, unitary construction and being formed as a single piece, and further including means biasing and urging said first jaw and said second jaw together to provide for the gripping therebetween of articles interposed therebetween;

said means biasing and urging said first jaw and said second jaw together comprise and extension formed upon the inner face of said first arm, with said extension having an elongated, generally ovoid protuberance formed thereon, and a cooperating socket formed on the inner face of said second arm;

said protuberance engaging with and securable within said socket to lock the relative positions of said first arm and said second arm, and thereby the relative positions of said first jaw and said second jaw, whereby;

two single articles comprising a matched pair are inserted between said first jaw and said second jaw, said first jaw and said second jaw are urged together and secured to grip the matched pair of articles therebetween, and said clip and the articles gripped therein are passed through a laundry cycle with said clip precluding the separation of the single articles and facilitating the sorting and proper storing thereof.

2. The chip according to claim 1 including:

means providing for the ready identification of said clip and any articles secured therein and assigned to a specific individual, said means comprising the coloring of each said clip.

3. The clip according to claim 1 including:

storage means for at least one said clip, comprising an open box having a rear side, and having a flange attached to the upper edge of said rear side and extending downward therefrom, with said rear side and said flange defining a gap therebetween, whereby;

said gap is installable over a wall of a laundry hamper to provide for the convenient storage and retrieval of said at least one said clip.

4. The clip according to claim 1 wherein:

said clip is formed of a pliable, resilient material.

5. The clip according to claim 4 wherein:

said pliable, resilient material is plastic.

6. In combination with a pair of stockings, a clip providing for the securing together of said stockings to form a matched pair thereof, comprising:

a first arm and a second arm, with said first arm and said second arm secured together at their respective proximal ends by a resilient connecting member and biased apart thereby;

said first arm and said second arm each respectively having a first jaw and a second jaw extending from the distal end thereof;

said first jaw and said second jaw each being disposed at substantially a right angle respectively to said first arm and said second arm, with said first arm and first jaw, and said second arm and said second jaw, each respectively forming a substantially T shaped configuration;

said clip having a monolithic, unitary construction and being formed as a single piece, and further including means biasing and urging said first jaw and said second jaw together to provided for the gripping therebetween of said stockings interposed therebetween;

said means biasing and urging said first jaw and said second jaw together comprise and extension formed upon the inner face of said first arm, with said extension having an elongated, generally ovoid protuberance formed thereon, and a cooperating socket formed on the inner face of said second arm;

said protuberance engaging with and securable within said socket to lock the relative positions of said first arm and said second arm, and thereby the relative positions of said first jaw and second jaw, whereby;

two single stockings comprising said pair of stockings are inserted between said first jaw and said second jaw, said first jaw and said second jaw are urged together and secured to grip said pair of stockings therebetween, and said clip and said stockings gripped therein are passed through a laundry cycle with said clip precluding the separation of said stockings forming said pair of stockings and facilitating the sorting and proper storing thereof.

7. The clip according to claim 6 including:

means providing from the ready identification of said clip and said pair of stockings secured therein and assigned to a specific individual, said means comprising the coloring of each said clip.

8. The clip according to claim 6 including:

storage means for at least one said clip, comprising an open box having a rear side, and having a flange attached to the upper edge of said rear side and extending downward therefrom, with said rear side and said flange defining a gap therebetween, whereby;

said gap is installable over a wall of a laundry hamper to provide for the convenient storage and retrieval of said at least one said clip.

9. The clip according to claim 6 wherein:

said clip is formed of a pliable, resilient material.

10. The clip according to claim 9 wherein:

said pliable, resilient material is plastic.

11. A clip providing for the securing together of single socks, stockings and hose to form a matched pair thereof, comprising:

a first arm and a second arm, with said first arm and said second arm secured together at their respective proximal ends by a resilient connecting member and biased apart thereby;

said first arm and said second arm each respectively having a first jaw and a second jaw extending from the distal end thereof;

said first jaw and said second jaw each being disposed at substantially a right angle respectively to said first arm and said second arm, with said first arm and first jaw, and said second arm and said second jaw, each respectively forming a substantially T shaped configuration;

said clip having a monolithic, unitary construction and being formed as a single piece, and further including means biasing and urging said first jaw and said second jaw together to provide for the gripping therebetween of articles interposed therebetween;

said means biasing and urging said first jaw and said second jaw together is adjustable and comprises a rod extending from the inner face of said second arm, with said rod including a distal end having a flange formed thereon and said flange including a plurality of notches therein;

said second arm having a slot formed therein, with said flange extending through said slot, wherein;

one of said notches of said flange is selectively engaged with said slot to catch upon an edge thereof and thereby lock the relative positions of said first arm and said second arm, and thereby the relative positions of said first jaw and said second jaw, whereby;

two single articles comprising a matched pair are inserted between said first jaw and said second jaw, said first jaw and said second jaw are urged together and secured to grip the matched pair of articles therebetween, and said clip and the articles gripped therein are passed through a laundry cycle with said clip precluding the separation of the single articles and facilitating the sorting and proper storing thereof.

12. The clip according to claim 11 including:

means providing for the ready identification of said clip and any articles secured therein and assigned to a specific individual, said means comprising the coloring of each said clip.

13. The clip according to claim 11 including:

storage means for at least one said clip, comprising an open box having a rear side, and having a flange attached to the upper edge of said rear side and extending downward therefrom, with said rear side and said flange defining a gap therebetween, whereby;

said gap is installable over a wall of a laundry hamper to provide for the convenient storage and retrieval of said at least one said clip.

14. The clip according to claim 11 wherein:

said clip is formed of a pliable, resilient material.

15. The clip according to claim 14 wherein: said pliable, resilient material is plastic.

* * * * *